US005692230A

United States Patent [19]

Yoshiuchi et al.

[11] Patent Number: 5,692,230

[45] Date of Patent: Nov. 25, 1997

[54] IMAGE FORMING APPARATUS

[75] Inventors: Katsuhiro Yoshiuchi; Hiroshi Kageyama, both of Osaka, Japan

[73] Assignee: Mita Industrial Co., Ltd., Osaka, Japan

[21] Appl. No.: 687,178

[22] Filed: Jul. 25, 1996

[30] Foreign Application Priority Data

Jul. 31, 1995 [JP] Japan ..... 7-195513

[51] Int. Cl.$^6$ ..... G03G 15/00

[52] U.S. Cl. ..... 399/21; 399/385

[58] Field of Search ..... 399/16, 21, 381, 399/384, 385; 271/256, 258.01, 259

[56] References Cited

U.S. PATENT DOCUMENTS

| | | | |
|---|---|---|---|
| 3,655,283 | 4/1972 | Margulis et al. | 399/21 |
| 3,815,990 | 6/1974 | Newcomb et al. | 399/21 |
| 4,084,900 | 4/1978 | Yamaoka et al. | 399/21 |
| 4,231,567 | 11/1980 | Ziehm | 271/259 |
| 4,878,428 | 11/1989 | Watarai | 399/21 X |
| 5,237,378 | 8/1993 | McEwen . | |

FOREIGN PATENT DOCUMENTS 722128 7/1996 European Pat. Off. .

OTHER PUBLICATIONS

JP Patent Abstract No. 03–051247, published May 3, 1991.
JP Patent Abstract No. 08–091658, published Sep. 4, 1996.
JP Patent Abstract No. 60–35754, published Feb. 23, 1985.
European Search Report and Annex No. 96305561 completed Nov. 7, 1996.

*Primary Examiner*—Sandra L. Brase
*Attorney, Agent, or Firm*—Beveridge, DeGrandi, Weilacher & Young, L.L.P.

[57] ABSTRACT

An image forming apparatus capable of simplifying work for removing a sheet by a user after a jam occurs. An image is formed on a sheet having a predetermined length cut from a rolled-sheet. A cutting mechanism is provided in a halfway portion of a conveying path through which the sheet passes. When a jam occurs in the conveying path, the cutting mechanism is operated, whereby the sheet is cut. The sheet in the apparatus can be immediately removed, therefore.

4 Claims, 8 Drawing Sheets

IMAGE FORMING APPARATUS

BACKGROUND OF THE INVENTION

1. Field of the Invention

The present invention relates to an image forming apparatus for forming an image on a sheet having a predetermined length cut from a strip-shaped continuous sheet.

2. Description of the Related Art

Conventionally, a copying machine so adapted as to optically scan an original, form an electrostatic latent image corresponding to the original on a photoreceptor on the basis of the scanning, develop the electrostatic latent image into a toner image, and then transfer the toner image to copy sheets has been widely used. As such a copying machine, a copying machine capable of copying an original of large size, for example, A0 size in Japanese Industrial Standard (JIS) (hereinafter referred to as "A0 size") has been provided.

The copying machine capable of copying an original of large size generally comprises a reading mechanism capable of reading the original of large size, and a conveying mechanism for conveying a copy sheet of large size corresponding to the original size.

As the above-mentioned copy sheet, a strip-shaped rolled-sheet wound around a rolled-sheet body is generally used. Specifically, the rolled-sheet is pulled out from the rolled-sheet body and is conveyed in a predetermined direction of conveyance along a conveying path, and a toner image is transferred to the rolled-sheet which is being conveyed. The rolled-sheet is cut at predetermined timing by a cutter mechanism, and a sheet obtained by the cutting is discharged. The reason why the rolled-sheet used is that previously cut sheets of large size such as A0 size are inconvenient in handling, and requires a wide containing space.

A jam may, in some cases, occur while the rolled-sheet is being pulled out and conveyed. When a jam occurs, copies cannot be normally made, wherefore the jam must be quickly solved.

Therefore, the copying machine generally comprises a jam detecting device, to forcedly stop the operation of the copying machine in response to judgment that a jam occurs by the jam detecting device. On the other hand, a user removes the rolled-sheet on the conveying path after the operation is stopped, to restore the copying machine to a state where it can be operated again.

In the above-mentioned copying machine, however, a longitudinal rolled-sheet is pulled out and is cut at predetermined timing as described above, whereby the operation of the copying machine may, in some cases, be stopped upon occurrence of a jam before the rolled-sheet is cut. In such a case, the rolled-sheet on the conveying path remains connected to the rolled-sheet body. Consequently, work for removing the long rolled-sheet is significantly complicated and requires a lot of time and labor.

Therefore, the sheet removing work has been conventionally generally performed after the rolled-sheet is cut upon user's manual operation. That is, the rolled-sheet may be cut by manually operating a handle mounted on the cutter mechanism or by manually operating a leading end cutting key to operate the cutter mechanism.

In this case, however, the troublesome manual operation by the user is still necessary for cutting the rolled-sheet after a jam occurs, and the sheet removing work after the occurrence of the jam is thus complicated.

SUMMARY OF THE INVENTION

An object of the present invention is to solve the above-mentioned technical problems and to provide an image forming apparatus capable of simplifying sheet removing work of a user after the occurrence of a jam.

An image forming apparatus according to the present invention forms an image on a sheet having a predetermined length cut from a strip-shaped continuous sheet. The image forming apparatus comprises image forming means for forming an image on the sheet, sheet conveying means for conveying the sheet along a conveying path passing through the image forming means, cutting means provided in any position of the conveying path for cutting the sheet, and jam detecting means for judging whether or not a jam occurs in the conveying path. When the jam detecting means judges that a jam has occurred, the cutting means is operated in response thereto, whereby the sheet is cut.

Consequently, a manual operation by a user is not necessary to cut the continuous sheet after a jam has occurred. Therefore, work for removing the continuous sheet after the occurrence of the jam is simplified.

In the embodiment of the present invention, when it is judged that a jam has occurred, the operation of the image forming apparatus is forced to be stopped after the sheet has been cut. Consequently, the user can immediately set about jam processing.

The cutting means may be operated only if it is judged that a jam has occurred when predetermined conditions are satisfied, while the cutting means may be prevented from operating if the above-mentioned predetermined conditions are not satisfied.

For example, it is assumed that the conveyance of the sheet is stopped once when the leading end of the sheet has reached to a predetermined position on the downstream side of the cutting means in a direction of sheet conveyance, after which the conveyance of the sheet is resumed. It is further assumed that the cutting means is operated at predetermined timing after the resumption of the conveyance of the sheet in order to cut to separate from the continuous sheet a sheet portion where an image is formed. In this case, it is preferable that the cutting means is operated in order to cut the sheet only if it is judged that a jam has occurred after the conveyance of the sheet has been resumed but before normal operation timing of the cutting means, while the cutting means is not operated even if a jam has occurred in the other time period. As a result, the sheet is not cut even if a jam has occurred in a state where the sheet has been cut and a state where the continuous sheet has not been pulled out up to the cutting means. The reason for this is that a jammed sheet can be easily removed without being cut in these states. It is thus possible to avoid a useless operation of the cutting means.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
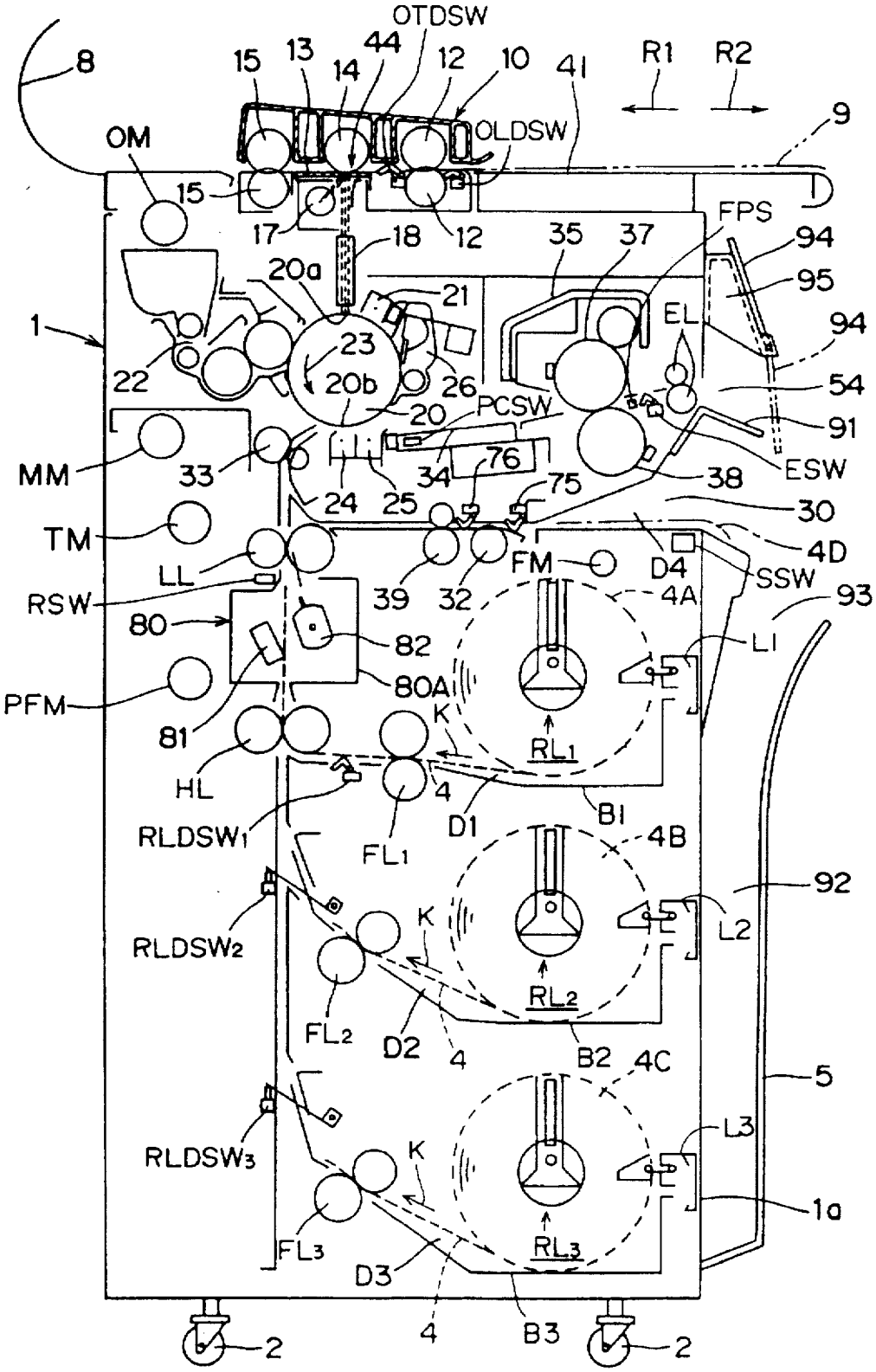
FIG. 1 is a sectional side elevation view schematically showing the internal construction of a copying machine which is one embodiment of an image forming apparatus according to the present invention.
Figure 2:
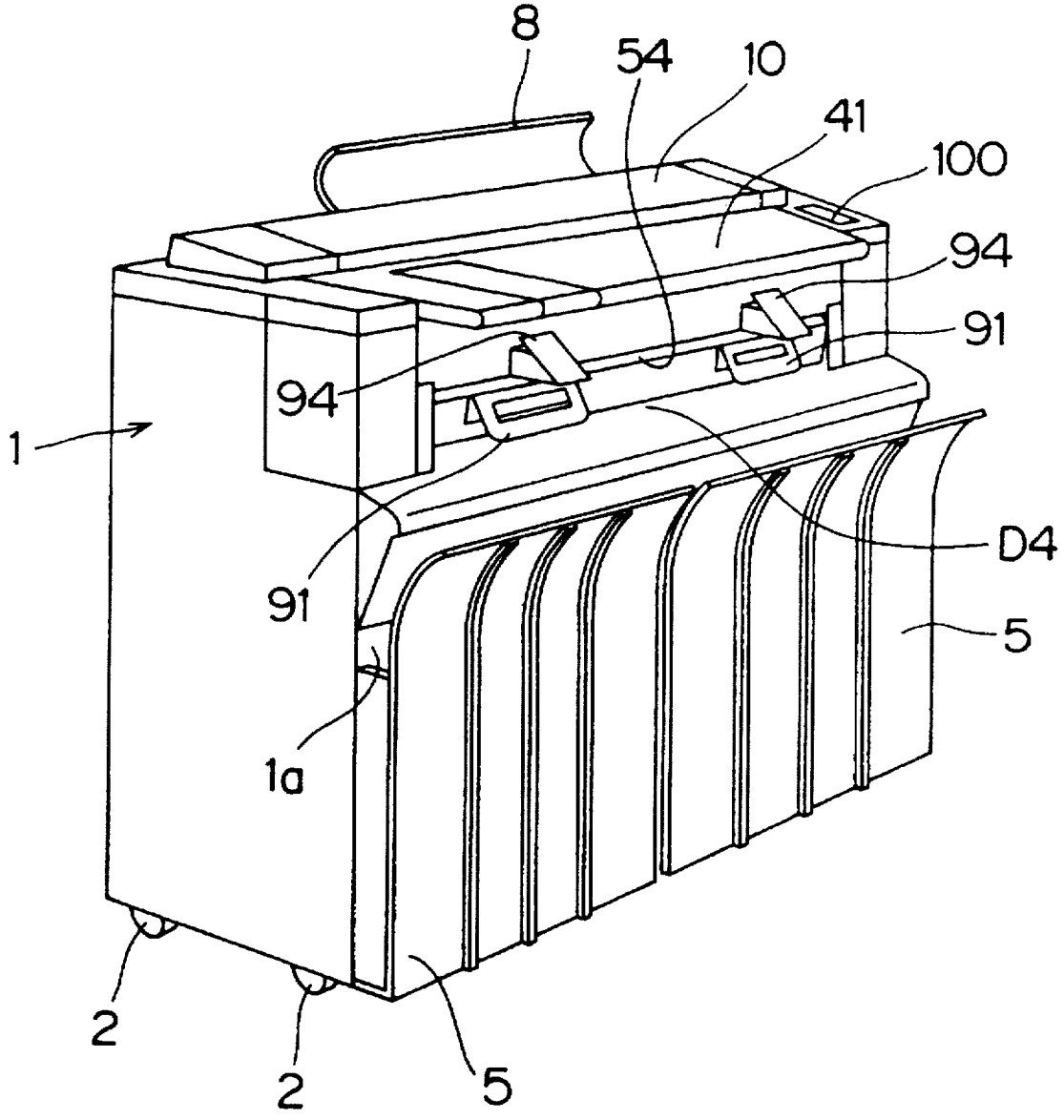
FIG. 2 is a perspective view showing the appearance of the copying machine shown in FIG. 1.
Figure 3:
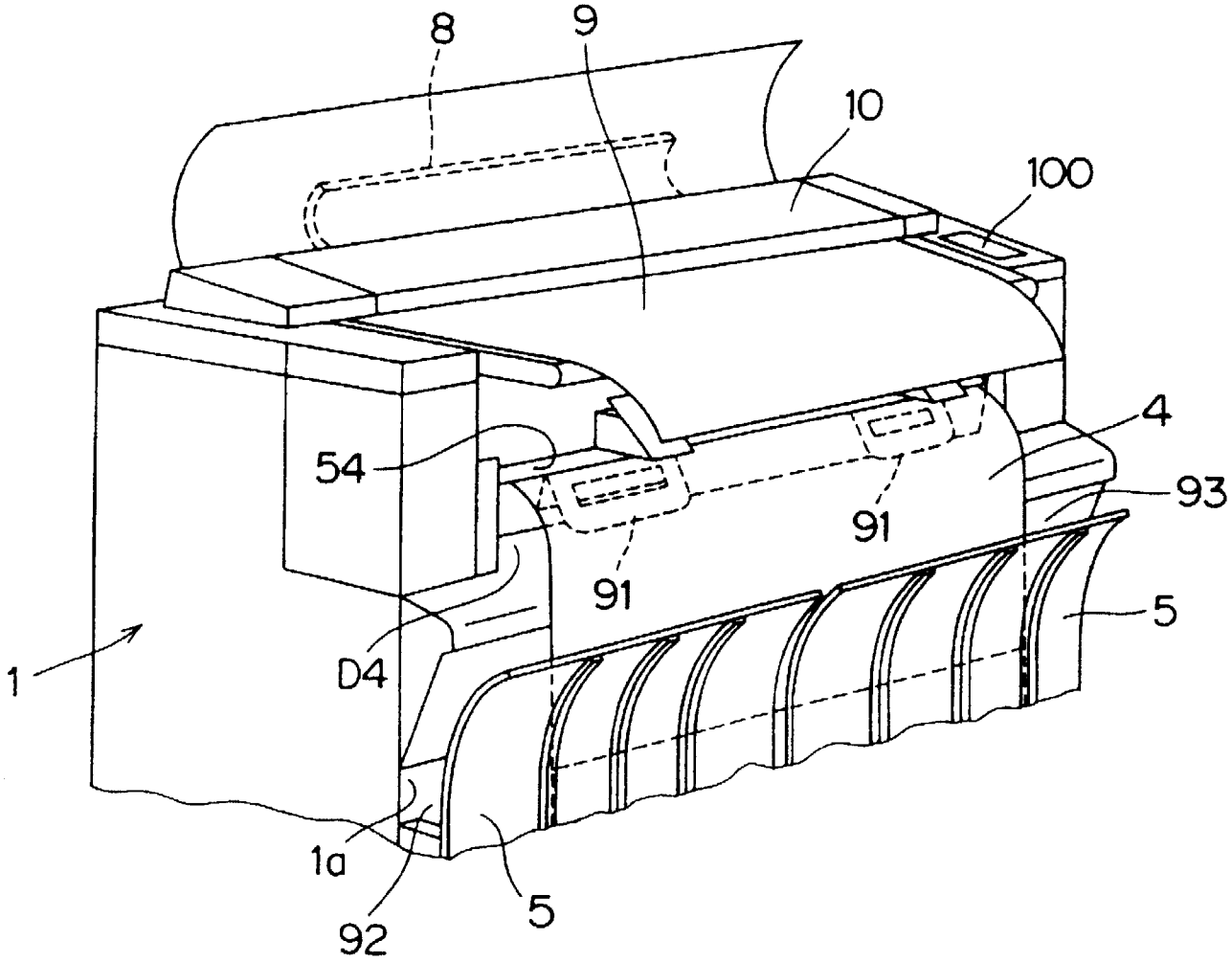
FIG. 3 is a perspective view showing the partial appearance at the time of copying of the copying machine shown in FIG. 1 in an enlarged manner.

FIG. 1 is a sectional side elevation view schematically showing the internal construction of a copying machine which is one embodiment of an image forming apparatus according to the present invention. FIG. 2 is a perspective view showing the appearance of the copying machine. Further, FIG. 3 is a perspective view showing the partial appearance at the time of manner. The copying machine can copy an original of large size such as A0 size. In the copying machine, the original is conveyed, while an original surface is illuminated and scanned by an optical system fixedly arranged. An image is formed on the basis of the illumination and scanning.

Caster wheels 2 are mounted on the bottom of a main body 1 of the copying machine, thereby making the main body 1 of the copying machine movable. An original conveying section 10 is provided on the top of the main body 1 of the copying machine. The original conveying section 10 is for conveying an original 9 along an original conveying path 41 formed on the upper surface of the main body 1 of the copying machine. A discharge port 54 for discharging sheets to which a toner image has been transferred is opened on a front surface 1*a* of the main body 1 of the copying machine. The sheets discharged from the discharge port 54 are dropped with the leading ends directed downward while being guided by guiding members 91 shown in FIG. 3. The dropped sheets are successively contained in a pocket 92 through an inlet opening 93. The pocket 92 is formed by a front cover 5 along the front surface 1*a* of the main body 1 of the copying machine. An operation section 100 is provided in an end of the upper surface of the main body 1 of the copying machine. Switches, keys, and the like for performing various setting related to copying operation including a leading end cutting key (not shown) are operation including a leading end cutting key (not shown) are arranged in the operation section 100. The leading end cutting key is operated for cutting a rolled-sheet with a cutting mechanism to make the leading end of the rolled-sheet straight, as described later.

In FIG. 1, sheet containing cases B1, B2, and B3 (hereinafter generically called "a sheet containing case B") are arranged in a portion below the center along the height of the main body 1 of the copying machine. The sheet containing cases B1, B2, and B3 are for respectively containing rolled-sheet bodies 4A, 4B, and 4C around which rolled-sheets 4 which are strip-shaped continuous sheets are wound. Examples of the rolled-sheet 4 include a plain paper sheet, a film, and a tracing paper sheet. The sheet containing cases B1, B2, and B3 respectively comprise rewind rollers $RL_1$, $RL_2$, and $RL_3$ also serving as roll shafts. The rolled-sheet bodies 4A to 4C are constructed by respectively winding the rolled-sheets 4 around the rewind rollers $RL_1$ to $RL_3$.

The sheet containing case B is arranged in the main body 1 of the copying machine so that it can be pulled out of the main body 1. The sheet containing cases B1, B2, and B3 respectively comprise levers L1, L2, and L3 for easily pulling out the sheet containing cases. The front surface 1*a* of the main body 1 of the copying machine can be opened and closed in the lateral direction in FIG. 1. In relation thereto, the main body 1 of the copying machine comprises a safety switch SSW for detecting the opening and closing of the front surface 1*a*. Specifically, the safety switch SSW is turned on when the front surface 1*a* is opened, while being turned off when the front surface 1*a* is closed.

Furthermore, a bypass conveying path D4 is provided around the center of the main body 1 of the copying machine. The bypass conveying path D4 is for feeding to the main body 1 a cut sheet 4D introduced into a manual sheet feeding section 30 provided on the front surface 1*a* of the main body 1. Examples of the cut sheet 4D include cut sheets of A0 size to A4 size.

From the rolled-sheet body 4A in the upper stage, the rolled-sheet 4 is conveyed in a direction of conveyance K along a first conveying path D1 leading to a photosensitive drum 20 successively through the rewind roller $RL_1$, sheet feeding rollers $FL_1$, a first leading end detecting switch $RLDSW_1$ for detecting the leading end of the rolled-sheet 4 conveyed, conveying rollers HL, a cutter mechanism 80, a registration switch RSW, registration rollers LL, and conveying rollers 33.

The first leading end detecting switch $RLDSW_1$ is turned on if the rolled-sheet 4 exists in a position where the switch is disposed, while being turned off if it does not exist at the position. Further, the registration switch RSW is employed when the rolled-sheet 4 is engaged with the registration rollers LL, which is turned on if the rolled-sheet 4 exists in a position where the switch is disposed, while being turned off if it does not exist at the position.

From the rolled-sheet body 4B in the intermediate stage, the rolled-sheet 4 is conveyed in the direction of conveyance K along a second conveying path D2 leading to the photosensitive drum 20 successively through the rewind roller $RL_2$, sheet feeding rollers $FL_2$, a second leading end detecting switch $RLDSW_2$ for detecting the leading end of the rolled-sheet 4 conveyed, the conveying rollers HL, the cutter mechanism 80, the registration switch RSW, the registration rollers LL, and the conveying rollers 33. A path succeeding the conveying rollers HL is common to the first conveying path D1.

From the rolled-sheet body 4C in the lower stage, the rolled-sheet 4 is conveyed in the direction of conveyance K along a third conveying path D3 leading to the photosensitive drum 20 successively through the rewind roller $RL_3$, sheet feeding rollers $FL_3$, a third leading end detecting switch $RLDSW_3$ for detecting the leading end of the rolled-sheet 4 conveyed, the conveying rollers HL, the cutter mechanism 80, the registration switch RSW, the registration rollers LL, and the conveying rollers 33. A path succeeding the conveying rollers HL is common to the first conveying path D1.

The conveying paths D1, D2, and D3 are hereinafter generically named "a conveying path D". The rewind rollers $RL_1$, $RL_2$, and $RL_3$ are hereinafter generically named "a rewind roller RL". Further, the sheet feeding rollers $FL_1$, $FL_2$, and $FL_3$ are generically named "sheet feeding rollers FL". Furthermore, the first leading end detecting switch $RLDSW_1$, the second leading end detecting switch $RLDSW_2$, and the third leading end detecting switch $RLDSW_3$ are hereinafter generically named "a leading end detecting switch RLDSW".

The bypass conveying path D4 is a path for leading to the photosensitive drum 20 a cut sheet 4D introduced from the manual sheet feeding section 30 successively through a fourth leading end detecting switch 75 for detecting the leading end of the cut sheet 4D conveyed, a separating roller 32 for separating cut sheets 4D (separating one at a time) by sliding contact with a friction plate(not shown), a fifth leading end detecting switch 76 for detecting the leading end of the cut sheet 4D conveyed, conveying rollers 39, and the conveying rollers 33. A path succeeding the conveying rollers 33 in the bypass conveying path D4 is common to the first conveying path D1.

The second, third, fourth and fifth leading end detecting switches $RLDSW_2$, $RLDSW_3$, 75 and 76 are the same as the first leading end detecting switch $RLDSW_1$.

The cutter mechanism 80 comprises in a casing 80A a longitudinal fixed blade 81 extending in a direction perpendicular to the direction of conveyance K of the rolled-sheet 4 and a rotating blade 82 for cutting the rolled-sheet 4 between the fixed blade 81 and the rotating blade 82. In the cutter mechanism 80, the rotating blade 82 is driven, whereby the rolled-sheet 4 is cut by interaction between the rotating blade 82 and the fixed blade 81.

The original conveying section 10 is for conveying the original and is capable of switching the direction of conveyance between a forward direction R1 and a reverse direction R2. An image forming operation is performed when the original is conveyed in the forward direction R1. When a plurality of copies are made from the same original, the original conveying section 10 alternatively switches the direction of conveyance to the forward direction R1 and the reverse direction R2, to convey the original 9. The above-mentioned original conveying path 41 is formed on the upper surface of the main body 1, extending to a position where it projects from the upper surface of the main body 1 on the upstream side of the original conveying section 10 in the forward direction R1.

The above-mentioned original conveying section 10 is constructed by successively arranging a first original end detecting switch OLDSW, first conveying rollers 12, a second original end detecting switch OTDSW, second conveying rollers 14, and third conveying rollers 15 along the forward direction R1.

The first conveying rollers 12 are for leading the set original to a transparent plate 13 in the original conveying section 10. The first conveying rollers 12 start to be driven in response to switching of the first original end detecting switch OLDSW from its off state to its on state to detect the leading end of the original 9 (an end on the downstream side in the forward direction R1). The second conveying rollers 14 is for bringing the original 9 into contact with the transparent plate 13 in order to subject the original 9 to slit exposure, which is provided in a position opposed to the transparent plate 13. The third conveying rollers 15 are for discharging the original 9 after being exposed.

Furthermore, the second original end detecting switch OTDSW is switched from its off state to its on state when the original 9 is conveyed in the forward direction R1, to detect the leading end of the original 9 in the forward direction R1. The rolled-sheet 4 starts to be driven in response to that the second original end detecting switch OTDSW is turned on. As a result, the conveyance of the original 9 and the conveyance of the rolled-sheet 4 are synchronized with each other.

The first original end detecting switch OLDSW is switched from its on state to its off state when the original 9 is conveyed in the forward direction R1, to detect the trailing end of the original 9. The cutter mechanism 80 is driven after an elapse of predetermined time since the trailing end is detected, whereby the rolled-sheet 4 is cut.

In the present embodiment, the length of a sheet feeding path of the rolled-sheet 4 from the cutter mechanism 80 to a position for transfer 20*b* of the photosensitive drum 20 is set to a larger length than the length of an original feeding path from the first original end detecting switch OLDSW to a position for original exposure 44 by a peripheral length from a position for exposure 20*a* of the photosensitive drum 20 to the position for transfer 20*b*. Consequently, an image corresponding to the trailing end of the original 9 can be formed at the trailing end of a sheet obtained by cutting the rolled-sheet 4 at the above-mentioned timing.

The second original end detecting switch OTDSW is switched from its on state to its off state when the original 9 is conveyed in the reverse direction R2, to detect the leading end of the original 9. In response to that the second original end detecting switch OTDSW is turned off, the driving of the conveying rollers 12, 14 and 15 is stopped. At this time, the leading end of the original 9 is held by the conveying rollers 12, thereby making the original 9 readily available for the subsequent copying operation.

Reference numeral 8 denotes a reversing member for reversing the direction of the original to prevent the original 9 from dropping into the back of the main body 1.

A light source 17 for illuminating the original surface of the original 9 is fixedly arranged in relation to the transparent plate 13. Light from the light source 17 is irradiated onto the surface of the original 9 through the transparent plate 13. Light reflected from the surface of the original 9 is directed to the surface of the photosensitive drum. 20 provided inside the main body 1 through a Selfoc lens 18. The surface of the photosensitive drum 20 before being exposed by the light from the Selfoc lens 18 is uniformly charged by a charging corona discharger 21. Therefore, an electrostatic latent image corresponding to an original image is formed on the surface of the photosensitive drum 20 after being exposed. The electrostatic latent image is developed into a toner image by a developing device 22. The toner image is led to the vicinity of a transferring corona discharger 24 by the rotation of the photosensitive drum 20 in a direction indicated by an arrow 23.

On the other hand, the rolled-sheet 4 led to the photosensitive drum 20 from the corresponding one of the sheet feeding paths D1, D2 and D3 is further led to the vicinity of the transferring corona discharger 24. The toner image on the surface of the photosensitive drum 20 is transferred to the rolled-sheet 4 by corona discharges in the transferring corona discharger 24. The rolled-sheet 4 to which the toner image has been transferred is separated from the surface of the photosensitive drum 20 by corona discharges in a separating corona discharger 25, and is further led to a fixing device 35 through a conveying path 34. The photosensitive drum 20, the charging corona discharger 21, the developing device 22, the transferring corona discharger 24, and the like thus constitute image forming means.

The conveying path 34 is provided with a conveying switch PCSW. The conveying switch PCSW is turned on if the rolled-sheet 4 exists in the conveying path 34, while being turned off if it does not exist therein.

In the fixing device 35, the rolled-sheet 4 is pressed and heated between a heat roller 37 and a pressure roller 38, whereby toner particles are fixed to the surface of the rolled-sheet 4. The rolled-sheet 4 to which the toner particles have been fixed is discharged to the outside of the main body 1 of the copying machine by discharge rollers EL through a discharge pulse switch FPS and a discharge switch ESW, and is contained in the pocket 92 as guided by the guiding members 91 as described above. On the other hand, the toner particles remaining on the surface of the photosensitive drum 20 after transferring the toner image are removed by a cleaning device 26, to prepare for formation of the subsequent electrostatic latent image. The cut sheet 4D led to the photosensitive drum 20 from the bypass conveying path D4 is also discharged into the pocket 92 after a toner image has been transferred and fixed thereto in the same manner.

The discharge switch ESW is turned on if the rolled-sheet 4 exists in a position where the switch is disposed, while being turned off if it does not exist at the position.

Guide assisting plates 94 are arranged above the guiding members 91. The guide assisting plates 94 are rotatably supported on stays 95 mounted on the front surface 1*a* of the main body 1. The guide assisting plates 94 are rotatably displaceable between a guiding position where they hang down ahead of the guiding members 91 to guide, in cooperation with the guiding members 91, the discharged rolled-sheet 4 to the pocket (indicated by a two-dot and dash line in FIG. 1) and a containing position where the guide assisting plates 94 are held on the stays 95 (indicated by a solid line in FIG. 1).

The copying machine is provided with a main motor MM for driving the photosensitive drum 20 and the developing device 22, a conveying rollers motor TM for driving the conveying rollers 33, a sheet feeding motor PFM for driving a group of rollers for feeding the sheets 4 and 4D toward the conveying rollers 33 and also for driving the cutter mechanism 80, a fixing motor FM for driving the heat roller 37 and the pressure roller 38 in the fixing device 35, and an original conveying motor OM for driving the original conveying section 10.

Figure 4A:
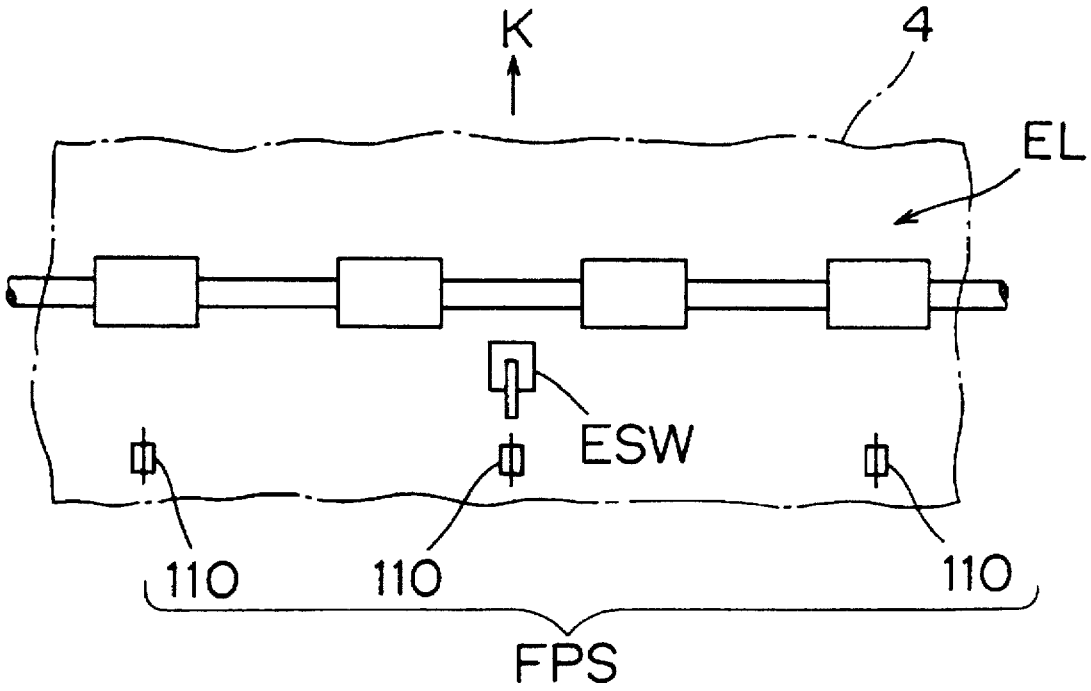
FIGS. 4A and 4B are illustrations showing the construction of a discharge pulse switch provided in the copying machine shown in FIG. 1.
Figure 4B:
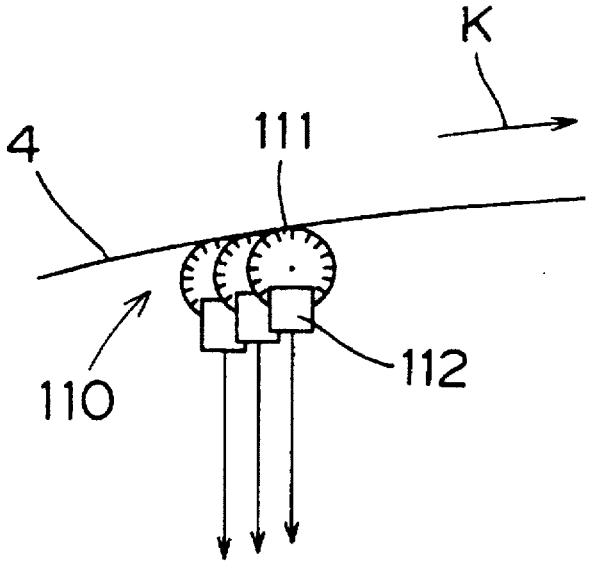

FIGS. 4A and 4B are diagrams for explaining the construction of the discharge pulse switch FPS. The discharge pulse switch FPS comprises a plurality of (three in the drawing) pulse output units 110. The pulse output units 110 are arranged at predetermined spacing in a direction perpendicular to the direction of conveyance K of the rolled-sheet 4 (the widthwise direction of the rolled-sheet 4). Each of the pulse output units 110 has a rotating disk 111 and a light-emitting/light-receiving element pair 112. The rotating disk 111 is rotatably arranged in a position where its peripheral surface is in contact with the rolled-sheet 4 being conveyed on the conveying path D. Consequently, the rotating disk 111 rotates as the rolled-sheet 4 passes through the conveying path D. A number of slits are formed radially, at equal spacing, with respect to a rotation center in a peripheral portion of the rotating disk 111. The light-emitting/light-receiving element pair 112 is arranged so that the peripheral portion of the rotating disk 111 is interposed between the light emitting element and the light receiving element which constitute the element pair 112. Light emitted by the light emitting element is fed to the light receiving element through one of the slits of the rotating disk 111.

In this construction, the rotating disk 111 rotates as the rolled-sheet 4 is conveyed. On the other hand, the light emitted from the light emitting element passes through one of the slits or is intercepted in a portion other than the slits as the rotating disk 111 rotates. An output of the light receiving element is therefore a pulse signal corresponding to intermittent receiving of light. The pulse signal is outputted only when the rolled-sheet 4 moves. If the movement of the rolled-sheet 4 is stopped upon occurrence of a jam, no pulse signal is outputted. Consequently, it can be judged whether or not a jam occurs depending on whether or not the pulse signal is continuously outputted.

Figure 5:
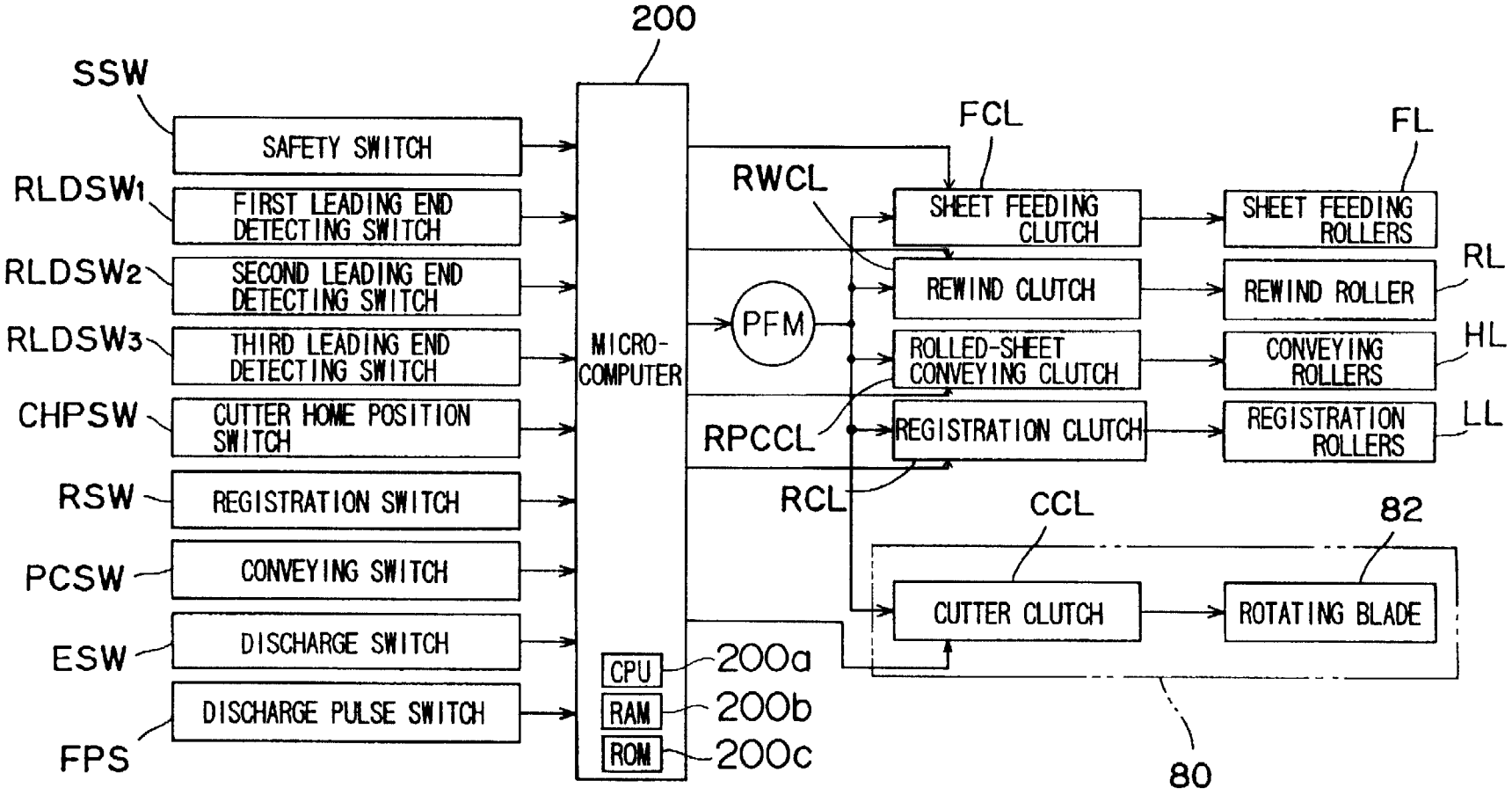
FIG. 5 is a block diagram showing the electrical construction of a control circuit provided in the copying machine shown in FIG. 1 and particularly related to the conveyance of a rolled-sheet.

FIG. 5 is a block diagram of a control circuit in the above-mentioned copying machine, particularly showing the electrical construction of a portion related to the conveyance of the rolled-sheet 4.

The control circuit comprises a microcomputer 200 serving as a control center. The microcomputer 200 includes a CPU 200*a*, a RAM 200*b* and a ROM 200*c*, and performs various types of processing such as processing for coping with a jam as described later in accordance with a control program stored in the ROM 200*c*.

Signals are inputted from various switches to the microcomputer 200. Specifically, signals from the safety switch SSW, the first leading end detecting switch $RLDSW_1$, the second leading end detecting switch $RLDSW_2$, the third leading end detecting switch $RLDSW_3$, a cutter home position switch CHPSW for judging whether or not the rotating blade 82 waits in its home position, the registration switch RSW, the conveying switch PCSW, the discharge switch ESW, and the discharge pulse switch FPS. Although output signals of all the other switches shown in FIG. 1 are inputted to the microcomputer 200, the illustration of parts of the switches is omitted in FIG. 5 in order to make the construction easy to understand.

The microcomputer 200 controls a sheet feeding mechanism on the basis of the input signals from the switches. Specifically, the microcomputer 200 controls on/off of the sheet feeding motor PFM, on/off of a sheet feeding clutch FCL for controlling a driving force to be applied to the sheet feeding rollers FL, and on/off of a rewind clutch RWCL for controlling a driving force to be applied to the rewind roller RL.

Furthermore, the microcomputer 200 controls on/off of a rolled-sheet conveying clutch RPCCL for controlling a driving force to be applied to the conveying rollers HL, and on/off of a registration clutch RCL for controlling a driving force to be applied to the registration rollers LL.

Additionally, the microcomputer 200 controls on/off of a cutter clutch CCL for selectively transmitting torque of the sheet feeding motor PFM to the rotating blade 82.

Figure 6:
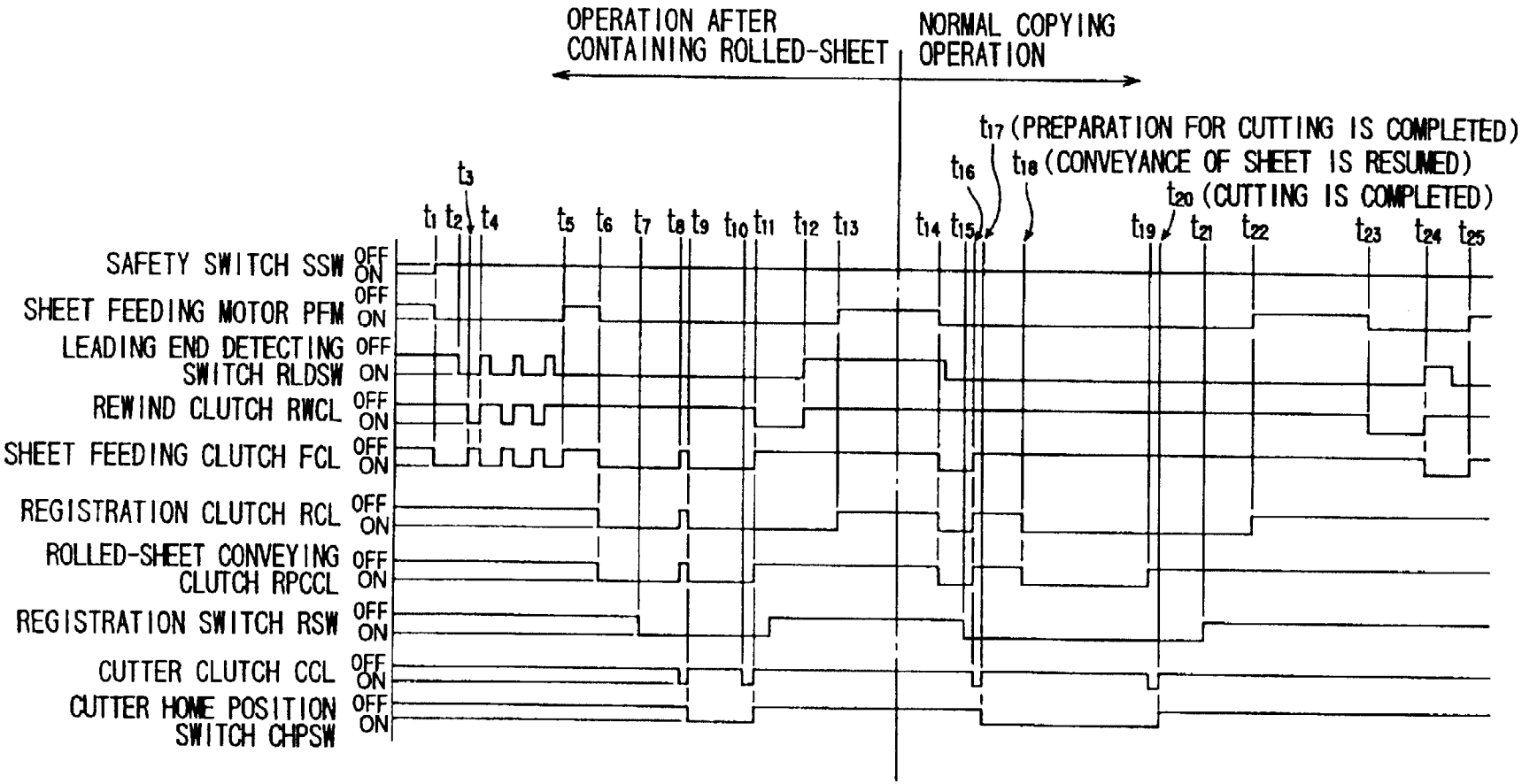
FIG. 6 is a timing chart showing an operation of the copying machine in which a rolled-sheet has been set and a normal copying operation.

FIG. 6 is a timing chart showing an operation of the copying machine immediately after the rolled-sheet 4 has been set, and a normal copying operation thereof. In the following description, FIGS. 6 and 1 will be referred to.

When the front surface 1*a* is opened in order to contain the rolled-sheet 4 in the sheet containing case B, the safety switch SSW is turned on. When the front surface 1*a* is closed after the rolled-sheet 4 has been contained, the safety switch SSW is turned off ($t_1$). If the safety switch SSW is turned off, slant correcting processing for aligning a leading end portion of the rolled-sheet 4 with the conveying path D is first performed.

Specifically, the sheet feeding motor PFM and the sheet feeding clutch FCL are turned on in response to that the safety switch SSW is turned on. As a result, the sheet feeding rollers FL are driven, and the rolled-sheet 4 is therefore conveyed in the direction of conveyance K along the conveying path D. When the leading end detecting switch RLDSW is turned on ($t_2$), the sheet feeding clutch FCL is turned off and the rewind clutch RWCL is turned on ($t_3$) after an elapse of predetermined time. As a result, the sheet feeding rollers FL are stopped and the rewind roller RL is driven. Consequently, the rolled-sheet 4 is returned in a direction opposite to the direction of conveyance K along the conveying path D. When the leading end detecting switch RLDSW is turned off ($t_4$), the rewind clutch RWCL is turned off in response thereto, and the sheet feeding clutch FCL is turned on. As a result, the rolled-sheet 4 is conveyed in the direction of conveyance K along the conveying path D again. The above-mentioned operations are repeated a total of three times. Consequently, the rolled-sheet 4 is aligned with the conveying path D, whereby the slant of the rolled-sheet 4 is prevented.

After an elapse of predetermined time ($t_5$) since the leading end detecting switch RLDSW has been turned on at the end of the slant correcting processing, the sheet feeding motor PFM and the sheet feeding clutch FCL are turned off. Thereafter, the copying machine is brought into a stand-by state until the leading end cutting key is turned on by the user. In this stand-by state, when the leading end cutting key is turned on by the user ($t_6$), leading end cutting processing is performed. The reason why the leading end cutting processing is performed is that the leading end of the rolled-sheet 4 is not necessarily cut straight.

In the leading end cutting processing, the sheet feeding motor PFM and the sheet feeding clutch FCL are first turned on, and the registration clutch RCL and the rolled-sheet conveying clutch RPCCL are turned on. As a result, the sheet feeding rollers FL, the registration rollers LL and the conveying rollers HL are driven. Consequently, the rolled-sheet 4 is conveyed in the direction of conveyance K along the conveying path D.

When the registration switch RSW is turned on ($t_7$), detecting the rolled-sheet 4 which has reached the registration switch RSW, the sheet feeding clutch FCL, the registration clutch RCL and the rolled-sheet conveying clutch RPCCL are turned off after an elapse of predetermined time ($t_8$). The sheet feeding clutch FCL and the like are turned off after an elapse of predetermined time in order to engage the rolled-sheet 4 with the registration rollers LL.

At the same time, the cutter clutch CCL is turned on. As a result, the rotating blade 82 is so rotated as to reach its home position. That is, the preparation of cutting is completed. When the cutter home position switch CHPSW is turned on ($t_9$) after the rotating blade 82 has reached the home position, the sheet feeding clutch FCL, the registration clutch RCL and the rolled-sheet conveying clutch RPCCL are turned on in response thereto. Consequently, the rolled-sheet 4 is conveyed toward the photosensitive drum 20. At the same time, the cutter clutch CCL is turned off.

Thereafter, when sufficient time for the rolled-sheet 4 to reach the discharge rollers EL has elapsed ($t_{10}$), the cutter clutch CCL is turned on over predetermined time in response thereto. Consequently, the rolled-sheet 4 is cut. As a result, the leading end of the rolled-sheet 4 is made straight. Thereafter, the cutter clutch CCL is turned off. At the same time, the sheet feeding clutch FCL and the rolled-sheet conveying clutch RPCCL are turned off, and the rewind clutch RWCL is turned on ($t_{11}$). Consequently, the rolled-sheet 4 is conveyed in the direction opposite to the direction of conveyance K along the conveying path D. When the leading end detecting switch RLDSW is turned off ($t_{12}$) after the rolled-sheet 4 has been returned to its home position, the rewind clutch RWCL is turned off.

On the other hand, while the above-mentioned operation is performed, a sheet obtained by cutting the rolled-sheet 4 is discharged to the outside of the main body 1 of the copying machine by the discharge roller EL. When the conveying switch PCSW is turned off ($t_{13}$), the sheet feeding motor PFM and the registration clutch RCL are turned off, whereby the copying machine proceeds to a copying stand-by mode.

Pre-copying processing is achieved by the above-mentioned operations.

When the original 9 is set in the original conveying section 10 after the pre-copying processing has been terminated, the conveyance of the original 9 is started. When the second original end detecting switch OTDSW is turned on ($t_{14}$), the sheet feeding motor PFM, the sheet feeding clutch FCL, the registration clutch RCL and the rolled-sheet conveying clutch RPCCL are turned on. As a result, the sheet feeding rollers FL, the registration rollers LL and the conveying rollers HL are driven. Consequently, the rolled-sheet 4 which has waited in the home position starts to be conveyed in the direction of conveyance K along the conveying path D.

When the registration switch RSW is turned on ($t_{15}$), the sheet feeding clutch FCL, the registration clutch RCL and the rolled-sheet conveying clutch RPCCL are turned off after an elapse of sufficient time to engage the leading end of the rolled-sheet 4 with the registration rollers LL ($t_{16}$). At the same time, the cutter clutch CCL is turned on. As a result, the rotating blade 82 is rotated. When the cutter home position switch CHPSW is turned on ($t_{17}$), the cutter clutch CCL is turned off. Consequently, the preparation of cutting is completed.

Thereafter, the registration clutch RCL and the rolled-sheet conveying clutch RPCCL are turned on in response to an elapse of predetermined time required to obtain synchronization with the conveyance of the original 9 ($t_{18}$) since the sheet feeding clutch FCL and the like have been turned on ($t_{14}$). Consequently, the rolled-sheet 4 is conveyed toward the photosensitive drum 20. A toner image formed on the photosensitive drum 20 is transferred to the rolled-sheet 4.

In this state, when the first original end detecting switch OLDSW for detecting the trailing end of the original 9 is turned off ($t_{19}$), the rolled-sheet conveying clutch RPCCL is turned off. After an elapse of predetermined time ($t_{20}$), the cutter clutch CCL is turned on. As a result, the rotating blade 82 starts to be rotated from the home position, whereby the rolled-sheet 4 is cut. The sheet obtained by cutting the rolled-sheet 4 is discharged to the outside of the copying machine by the discharge rollers EL. When the registration switch RSW is turned off ($t_{21}$), and the conveying switch PCSW is turned off ($t_{22}$), the registration clutch RCL and the sheet feeding motor PFM are turned off.

Thus one cycle of an image transferring operation has been achieved.

When the copying machine enters a state where the machine is operatable for the subsequent copying operation after one cycle of the image transferring operation has been performed, the sheet feeding motor PFM and the rewind clutch RWCL are turned on ($t_{23}$). As a result, the rolled-sheet 4 which has been already pulled out to the cutter mechanism 80 is rewound. When the leading end detecting switch RLDSW is turned off ($t_{24}$), the rewind clutch RWCL is turned off, and the sheet feeding clutch FCL is turned on. As a result, the rolled-sheet 4 is conveyed in the direction of conveyance K along the conveying path D again. After an elapse of predetermined time ($t_{25}$) since the leading end detecting switch RLDSW has been turned on, the sheet feeding motor PFM and the sheet feeding clutch FCL are turned off, whereby the copying machine enters the stand-by state.

In the copying machine, there may occur a case where the rolled-sheet 4 is not normally conveyed, that is, a jam occurs. In this case, the copying machine must be restored to a state where it is operatable for copying by removing the jammed portion of the rolled-sheet 4 on the conveying path D.

When a jam occurs after the rolled-sheet 4 is cut, work for removing the rolled-sheet 4 can be performed relatively easily because the rolled-sheet 4 is separated from the corresponding one of the rolled-sheet bodies 4A to 4C. When a jam occurs before the leading end of the rolled-sheet 4 has reached the cutter mechanism 80, the sheet removing work can also be performed relatively easily because the portion of the rolled-sheet 4 which has been pulled out from the corresponding one of the rolled-sheet bodies 4A to 4C is not so long.

On the other hand, a problem arises where a jam occurs after the leading end of the rolled-sheet 4 has passed through the cutter mechanism 80 but before the rolled-sheet 4 is cut. That is, because the long rolled-sheet 4 pulled out remains connecting to the corresponding one of the rolled-sheet bodies 4A to 4C, work for removing the long rolled-sheet 4 is significantly complicated.

In the copying machine according to the present embodiment, where a jam occurs after the conveyance of the sheet has been resumed upon completion of the preparation of cutting but before the cutting of the rolled-sheet 4 is completed, processing for coping with a jam which characterizes the present embodiment is performed.

Figure 7:
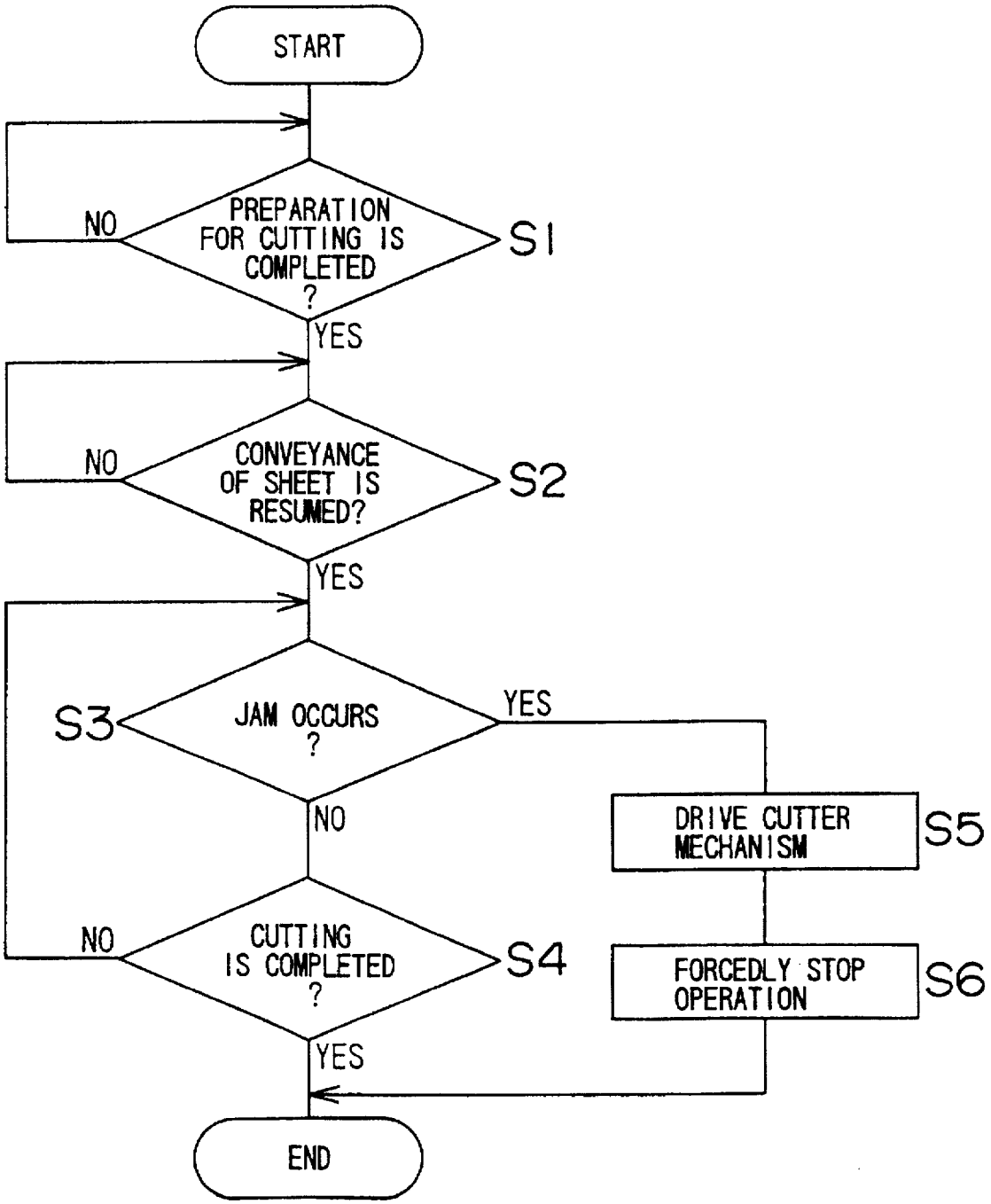
FIG. 7 is a flow chart for explaining processing for coping with a jam.

FIG. 7 is a flow chart for explaining processing for coping with a jam. The processing for coping with a jam is performed by the microcomputer 200.

Where the preparation of cutting has been completed (YES in step S1: $t_{17}$ in FIG. 6) and the conveyance of the rolled-sheet 4 has been resumed (YES in step S2: $t_{18}$ in FIG. 6), the microcomputer 200 judges whether or not a jam occurs (step S3). The judgment whether or not a jam occurs is continued until the cutting of the sheet is completed (step S4: $T_{20}$ in FIG. 6).

It is judged whether or not a jam occurs depending on whether or not the following conditions are satisfied.

Figure 8A:
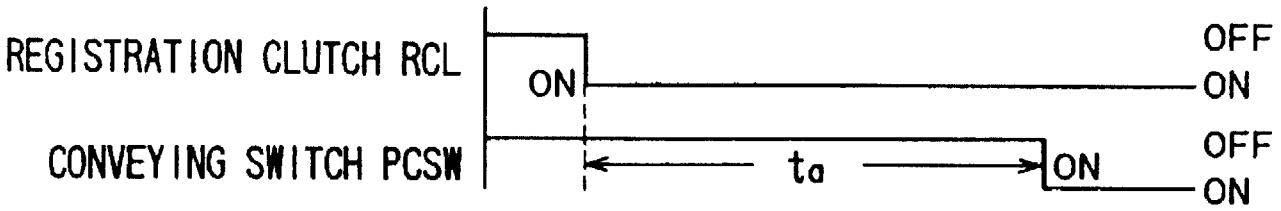
FIGS. 8A, 8B and 8C are timing charts for explaining conditions for judging whether or not a jam occurs.

Specifically, referring to FIG. 8A, if the conveying switch PCSW is not turned on even if not less than predetermined time $t_a$ (for example, $t_a$=4.75 (sec.)) has elapsed since the registration clutch RCL has been turned on, it is judged that a jam occurs. That is, when the registration clutch RCL is turned on ($t_{18}$ in FIG. 6), the conveyance of the rolled-sheet 4 is resumed. At this time, if no jam occurs, the rolled-sheet 4 is to reach a position where the conveying switch PCSW is provided before the predetermined time $t_a$ has elapsed. If the conveying switch PCSW is not turned on after an elapse of the predetermined time $t_a$ since the registration clutch RCL has been turned on, therefore, it can be judged that a jam occurs on the conveying path preceding the conveying switch PCSW.

Figure 8B:
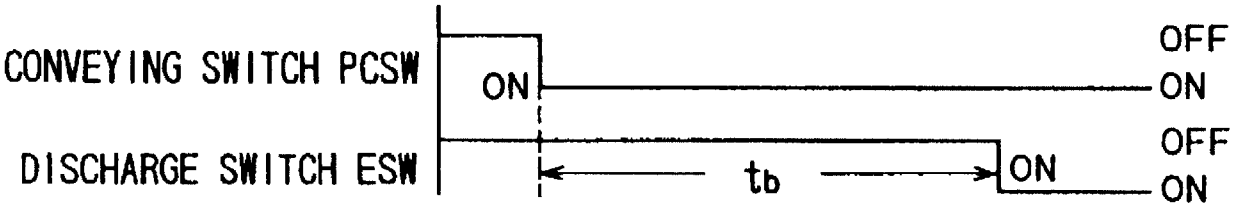

Referring to FIG. 8B, if the discharge switch ESW is not turned on even if not less than predetermined time $t_b$ has lapsed since the conveying switch PCSW has been turned on, it is judged that a jam occurs. That is, if no jam occurs, the rolled-sheet 4 is to reach the discharge switch ESW before an elapse of the predetermined time $t_b$ since the conveying switch PCSW has been turned on. If the conveying switch ESW is not turned on even if the predetermined time $t_b$ has elapsed, therefore, it can be judged that a jam occurs on the conveying path between the conveying switch PCSW and the discharge switch ESW.

Figure 8C:
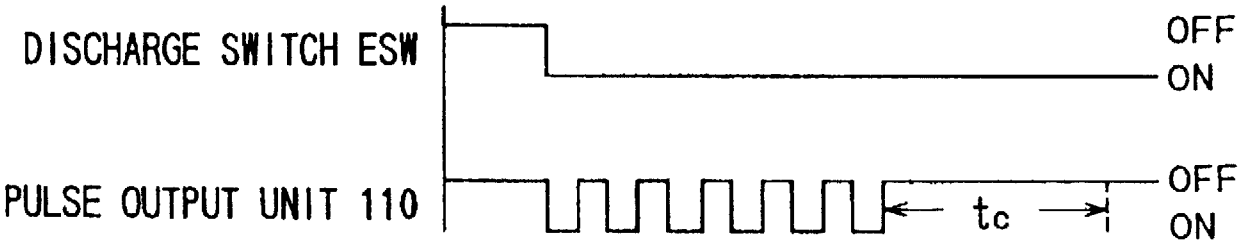

Furthermore, referring to FIG. 8C, if a pulse signal is not continuously outputted for not less than predetermined time $t_c$ from any one of the pulse output units 110 in the discharge pulse switch FPS although the discharge switch ESW is turned on, for example, it is judged that a jam occurs. In this case, a jam may occur in a leading end portion of the rolled-sheet 4.

Upon judgment that a jam occurs as a result of the judgment in the foregoing step S3, the microcomputer 200 drives the cutter mechanism 80 unconditionally in response thereto (step S5). Specifically, the microcomputer 200 turns the cutter clutch CCL on, to rotate the rotating blade 82. As a result, the rolled-sheet 4 is cut. After the cutting, the copying operation is forced to be stopped (step S6).

As described in the foregoing, according to the copying machine in the present embodiment, when a jam occurs after the preparation for cutting has been completed and the conveyance of the rolled-sheet 4 has been resumed but before the cutting is completed, the cutter mechanism 80 is driven in response thereto to cut the rolled-sheet 4, after which the copying operation is forced to be stopped. Consequently, the user need not perform a manual operation to cut the rolled-sheet 4 after a jam occurs. Consequently, the work for removing the rolled-sheet 4 after the occurrence of a jam is simplified.

Although in the above-mentioned embodiment, the sheet 4 is cut only when a jam occurs after the conveyance of the rolled-sheet 4 has been resumed but before the cutting of the sheet is completed, the cutter mechanism 80 may be operated whenever a jam occurs. As a result, a control operation of the microcomputer 200 is simplified.

Although in the above-mentioned embodiment, description has been made by taking a copying machine as an example, the present invention is applicable to the other image forming apparatuses such as a printer. Further, the present invention is also applicable to an apparatus for forming an image by a process other than an electrophotographic process, for example, an ink-jet process or a thermal transfer process.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An image forming apparatus for forming an image on a sheet having a predetermined length cut from a strip-shaped continuous sheet, comprising:

image forming means for forming an image on the sheet;

sheet conveying means for conveying the sheet along a conveying path passing through the image forming means;

cutting means, provided in a position on the conveying path, for cutting the sheet;

jam detecting means for judging whether or not a jam occurs in the conveying path; and jam-mode cutting controlling means for causing the cutting means to operate for cutting the sheet in response to a judgment that a jam has occurred by the jam detecting means.

2. An image forming apparatus according to claim 1, further comprising forced stop controlling means for forcedly stopping an operation of the image forming apparatus after the cutting means has cut the sheet under control by the jam-mode cutting controlling means if the jam detecting means judges that a jam has occurred.

3. An image forming apparatus according to claim 1, wherein the jam-mode cutting controlling means causes the cutting means to operate for cutting the sheet if the jam detecting means judges that a jam has occurred when predetermined conditions are satisfied.

4. An image forming apparatus according to claim 1, wherein the conveying means stops once the conveyance of the sheet when a leading end of the sheet has reached a predetermined position on a downstream side of the cutting means with respect to a direction of sheet conveyance, and then resumes the conveyance of the sheet, the image forming apparatus further comprises normal-mode cutting controlling means for causing the cutting means to operate at predetermined timing after the resumption of the conveyance of the sheet by the conveying means in order to cut to separate from the strip-shaped continuous sheet a sheet portion where an image is formed by the image forming means, and the jam-mode cutting controlling means causes the cutting means to operate for cutting the sheet if it is judged that a jam has occurred by the jam detecting means after the conveyance of the sheet has been resumed but before the cutting means is caused to operated by the normal-mode cutting controlling means.

* * * * *